US005799935A

United States Patent [19]

Yamanushi et al.

[11] Patent Number: 5,799,935

[45] Date of Patent: Sep. 1, 1998

[54] AUTOMATIC STAPLING DEVICE

[75] Inventors: Satoshi Yamanushi, Nirasaki; Naoto Mochizuki, Kofu, both of Japan

[73] Assignee: NISCA Corporation, Yamanashi, Japan

[21] Appl. No.: 751,406

[22] Filed: Nov. 18, 1996

[30] Foreign Application Priority Data

Nov. 16, 1995 [JP] Japan ..... 7-322346

[51] Int. Cl.[6] ..... B27F 7/17

[52] U.S. Cl. ..... 270/58.08; 270/58.27

[58] Field of Search ..... 270/58.08, 58.23, 270/58.27, 58.01, 58.07

[56] References Cited

U.S. PATENT DOCUMENTS

| | | | |
|---|---|---|---|
| 4,175,314 | 11/1979 | Spehrley, Jr. | 29/432.1 |
| 4,557,410 | 12/1985 | Holden et al. | 227/155 |
| 4,586,640 | 5/1986 | Smith | 227/14 |
| 4,623,082 | 11/1986 | Kurosawa | 227/7 |
| 4,716,813 | 1/1988 | Prudencio | 91/355 |
| 4,830,256 | 5/1989 | Kramer | 227/124 |
| 4,903,952 | 2/1990 | Russel et al. | 270/53 |
| 5,018,656 | 5/1991 | Phelps | 227/84 |
| 5,106,066 | 4/1992 | Shea et al. | 270/37 |
| 5,141,143 | 8/1992 | Ebner et al. | 227/129 |
| 5,346,114 | 9/1994 | Udagawa et al. | 227/120 |
| 5,454,503 | 10/1995 | Udagawa et al. | 227/82 |
| 5,586,710 | 12/1996 | Golicz | 227/155 |

*Primary Examiner*—David A. Okonsky

*Attorney, Agent, or Firm*—Kane,Dalsimer,Sullivan,Kurucz, Levy, Eisele and Richard, LLP

[57] ABSTRACT

A stapling device including a staple driver for inserting a staple into sheets and a clincher for bending the staple piercing through the sheets, which are opposed to each other astride a sheet passage, is provided with shifting means for bringing the staple driver and clincher close to each other in stapling operation, and widely separating said staple driver from said clincher in standing ready for stapling. The sheet passage is widely secured between the staple driver and the clincher on standby so as to allow the sheets to smoothly enter into the sheet passage. This stapling device provides an automatic sheet binding function suitably applicable as a bookbinding system for an image forming device such as a printer and copying machine.

28 Claims, 11 Drawing Sheets

AUTOMATIC STAPLING DEVICE

BACKGROUND OF THE INVENTION

1. Field of the Invention

This invention relates to a stapling device for automatically binding sheets by using at least one or more staples, and more particularly to an automatic stapling device capable of sufficiently widening a sheet receiving space between a staple driver and a clincher opposed to the staple driver astride a sheet passage when forwarding a sheaf of sheets through the sheet passage in standing by ready for stapling, thus to successfully and stably feed the sheets without hindrance.

2. Description of the Prior Art

There has been used a sheet binding or finishing system having a stapling device to be attached to the sheet discharge part of an image forming device such as a printer and a copying machine in order to automatically bind sheets discharged one by one from the image forming device into a sheaf of sheets bound with one or more staples.

In a stapling device to be attached to such an image forming device as described in Japanese Patent Public Disclosure HEI 2-219601(A) and Japanese Utility Model Public Disclosure HEI 6-63342(A), a staple driver and an anvil are separated to form a sheet passage therebetween, so that a sheaf of sheets can be fed in a sheet forward direction to a stapling position defined between the staple driver and the anvil, and sent out along the sheet passage in the same sheet forward direction after stapling the sheaf of sheets at the stapling position.

Another stapling device is also disclosed in U.S. Pat. No. 4,720,033 to Olesen, in which a staple driver and an anvil are united with pivot so that a sheaf of sheets is fed in the sheet forward direction into the stapling position between the staple driver and the anvil and bind the sheets there with a staple. However, this stapling device entails problem such that the sheaf of sheets bound at the stapling position must be sent back in the reverse direction in order to be discharged after stapling.

Thus, the former separate type stapling device can be suitably used as a finishing device to be attached to the sheet discharge part of the image forming device, but it disadvantageously requires a high-level controlling system capable of synchronously moving the separated staple driver and anvil in parallel along the edge of the sheaf of sheets, which is perpendicular to the sheet forward direction, and inducing coordinated movements of the staple driver and anvil for stapling.

To be more specific, a stapling device as described in Japanese Utility Model Public Disclosure HEI 6-63342(A) as one example has a driving mechanism required for actuating the staple driver and anvil to perform the stapling operation, in which a clincher for bending staple legs piercing through the sheets to insure the stapled state is incorporated in the anvil. Such a stapling device necessitates a remarkably complicated driving system so as to operatively associate the staple driver, anvil and clincher with one another.

Although the aforementioned conventional stapling device generally has the staple driver and the clincher retained apart from each other at the regular distance determined in accordance with the length of the legs of the staple, the distance corresponding to the height of the sheet passage, at which the staple driver and the clincher are separated, could not be made sufficiently larger than the length of the legs of the staple.

Accordingly, the sheet receiving space in the conventional stapling device, through which the sheaf of sheets is permitted to pass, is too narrow to reliably transport the sheets, thus possibly suffering failure to forward the: sheets when handling lots of sheets or flexible sheets. In order to remedy such a drawback, sheet guides may of course be disposed along the sheet passage, but the conventional stapling device having a structural defect that the sheet receiving space formed between the staple driver and the clincher cannot be enlarged nor improve the sheet feeding performance.

OBJECT OF THE INVENTION

An object of the present invention is to provide an automatic stapling device capable of precisely and stably operating a staple driver and a clincher in concert by a single common driving means, and enlarging a sheet receiving space between the staple driver and the clincher so as to easily and successfully introduce sheets into the staple receiving space when standing by ready for stapling.

Another object of the present invention is to provide an automatic stapling device having excellent performance, durability and stability of stapling operation, which incorporates a small and light driving system capable of actuating the staple driver and clincher without using a complicated controlling system such as a high-level servomechanism.

Still another object of the present invention is to provide an automatic stapling device capable of heightening the stability of positioning a sheaf of sheets in stapling by differentially driving operative components of the staple driver and clincher so as to fulfill a high-quality stapling function.

Yet another object of the invention is to provide an automatic stapling device having a simple positioning mechanism capable of precisely and stably bringing the staple driver and clincher to a prescribed stapling position with ease by using a single driving power source.

A further object of the present invention is to provide a handy and simple automatic stapling device capable of being easily maintained and attached to the sheet discharge part of an image forming device such as a printer and a copying machine, and automatically inserting at least one staple into one or more stapling points defined on the sheaf of sheets successively discharged from the image forming device, thereby to bind the sheets quickly.

SUMMARY OF THE INVENTION

To attain the objects described above according to the present invention, there is provided an automatic stapling device comprising a staple driver for inserting a staple into a sheaf of sheets, a clincher for bending the staple piercing through the sheets, stapling drive means having a single driving power source for producing driving power to render stapling operation of the staple driver and clincher, means for shifting the relative position of the staple driver and the clincher so as to narrow a sheet receiving space between the staple driver and the clincher when stapling and widen the sheet receiving space in standing by ready for stapling, and means for transmitting the driving power from the stapling drive means respectively to the staple driver and the clincher.

The shifting means may be formed of tilting means disposed on at least one of the stapling driver and the clincher, so that one of the stapling driver and clincher, on which the tilting means is disposed, is brought near to the other while stapling and kept away from the other in standing ready for stapling.

The stapling device is provided with position setting means for synchronously moving the staple driver and the clincher in parallel to the stapling position. The opposed staple driver and clincher are cooperatively driven at the stapling position by the position setting means, thus performing the stapling operation precisely.

The stapling drive means incorporates a single electric motor as a driving power source for operating the staple driver and clincher to perform the stapling operation. The motor may be mounted on one of side plates of a frame of the device or incorporated into one of the staple driver and the clincher.

Angular movement of the staple driver by the tilting means for the staple driver is carried out in relation to the operation of thrusting a staple. The tilting means for the clincher has a clincher driving shaft provided with one or more anvil rocking cams for rockingly moving an anvil base and a clincher rocking cam for rockingly moving the clincher, so that the clincher driving shaft is rotated in conjunction with the driving shaft for the staple driver, and consequently, the staple driver and clincher which are widely separated from each other in standing ready for stapling are brought close to each other when carrying out the stapling operation.

Since the staple driver and the clincher are widely separated when standing ready for stapling, sheets can be securely introduced into the sheet passage formed between the staple driver and the clincher without hindrance.

By differentially operating the anvil rocking cam and the clincher rocking cam with the tilting means to bring the anvil base to the stapling position before the staple driver is positioned at the stapling position, the sheets arriving at the stapling position can be steadily held in place on the anvil base prior to stapling. Thus, precise stapling operation can be fulfilled without causing slippage of sheets.

Other objects and features of the present invention will be hereinafter explained in detail with reference to the accompanying drawings.

DESCRIPTION OF THE PREFERRED EMBODIMENTS

This invention relates to a stapling device which is attached to an image forming device such as a printer and a copying machine to receive and automatically bind sheets discharged from the image forming device into a bound sheaf, and can stably fulfill a function of allowing the sheets discharged from the image forming device to be brought to a stapling position with a simple driving mechanism. Particularly, the device of this invention is featured by providing shifting means for changing a sheet receiving space of a sheet passage formed between a staple driver and a clincher so as to make the sheet receiving space wider when standing by ready for stapling.

Figure 1:
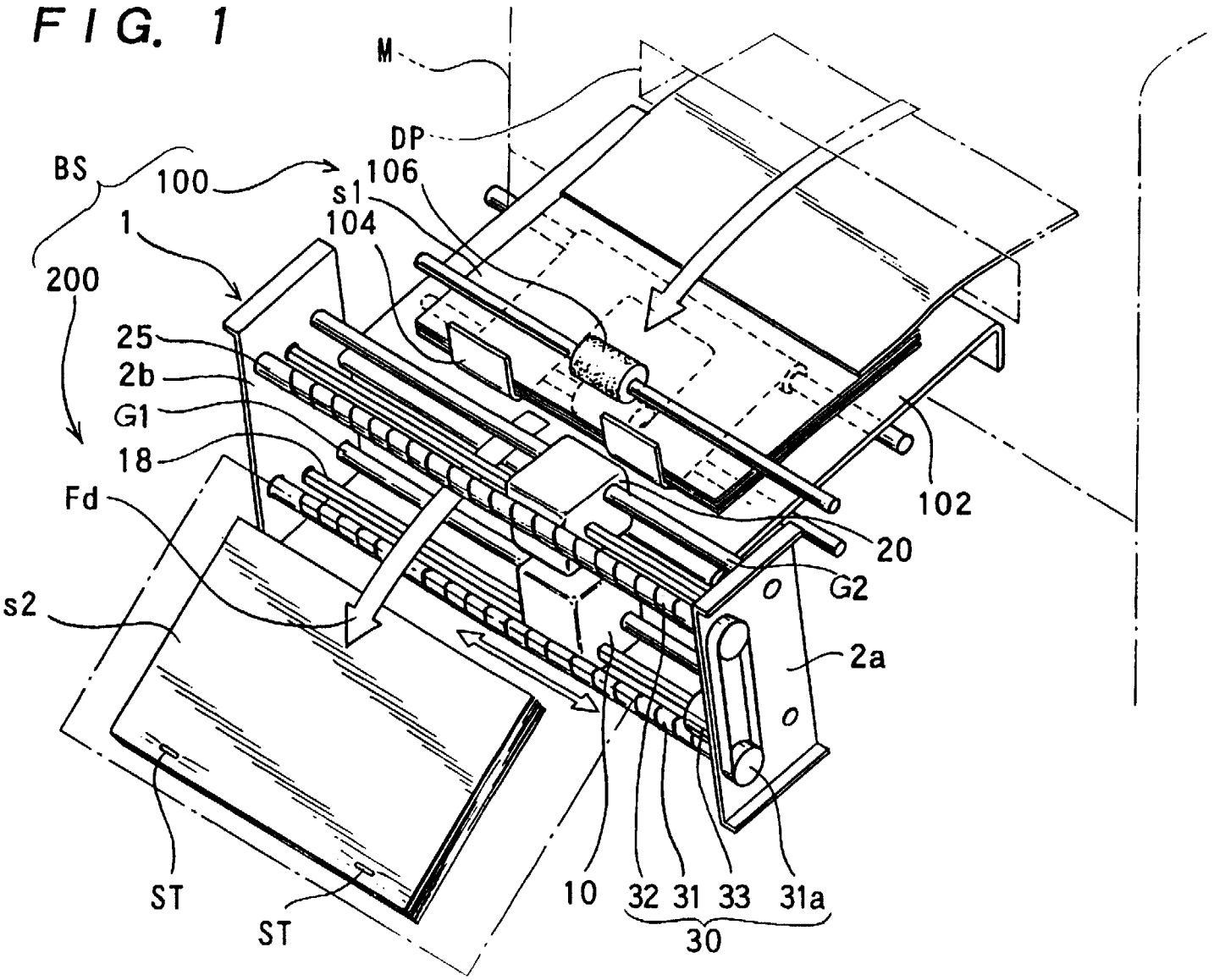
FIG. 1 is a perspective view schematically showing one example of an, automatic stapling device of this invention applied to an image forming device.

As shown in FIG. 1 as one example, the stapling device 1 according tar this invention may be used as one element of a finishing system or bookbinding system BS to be fitted to a sheet discharge part DP of the image forming device M.

In addition to the stapling device 1 of this invention, the finishing system BS includes a sheet collating unit 100 disposed between the stapling device 1 and the image forming device M and adapted for collating the sheets sl discharged from the image forming device M into a sheaf and forward the sheaf of sheets to the stapling device 1, and a finish stacker 200 for receiving a finished sheaf of sheets s2 bound by the stapling device 1.

Figure 2:
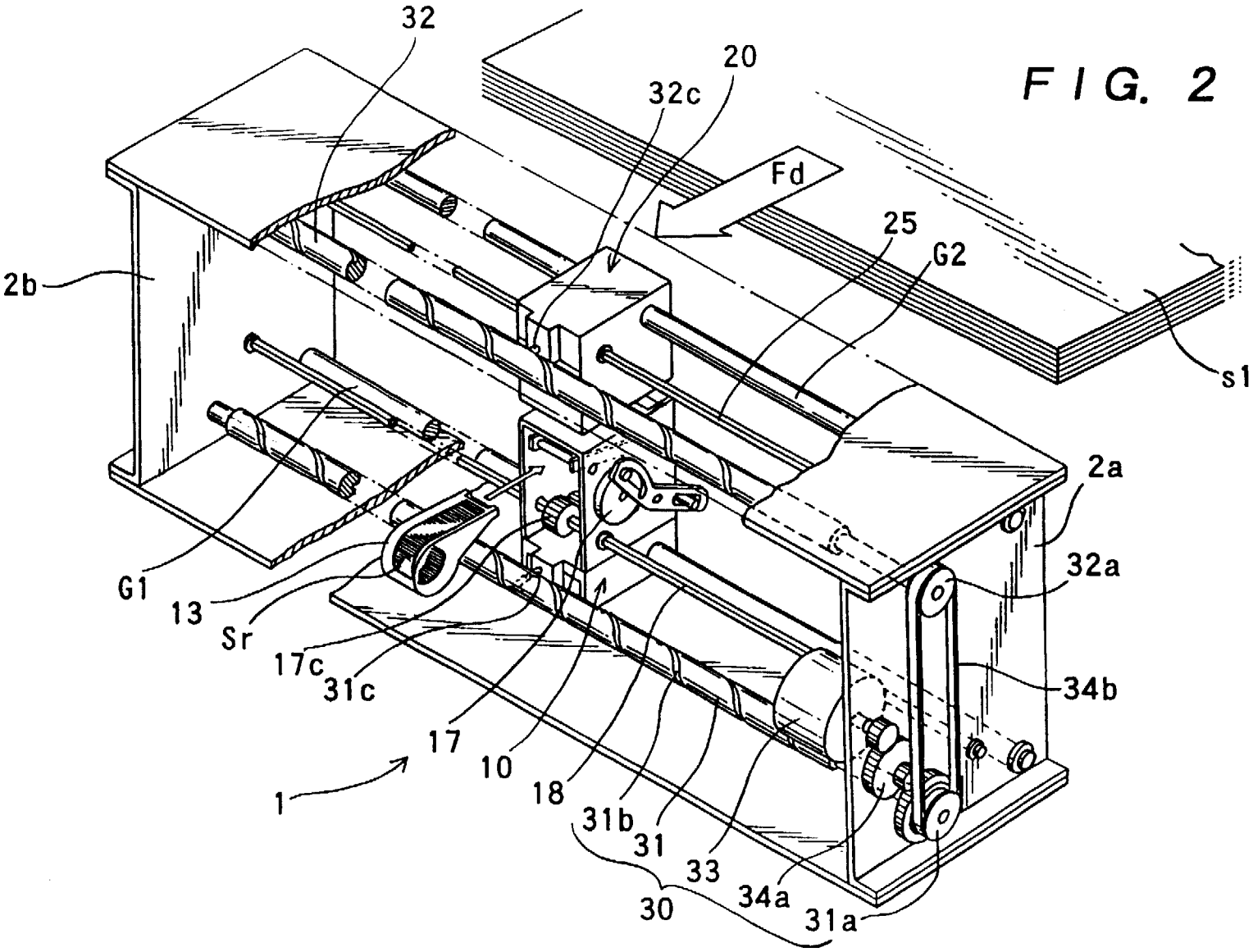
FIG. 2 is a partially sectioned perspective view schematically showing one embodiment of the automatic stapling device of this invention.

The collating unit 100 comprises a sheet catch tray 102, a retractable stopper means 104 for checking the advance of the sheets s2 discharged from the image forming device M onto the sheet catch tray 102 in order to true up the leading edges of the sheets, and a sheet transport means 106 including rollers for allowing the sheets placed in order on the sheet catch tray 102 to be sent toward the stapling device 1 and brought to a stapling position Ps (FIG. 2).

When the leading end portion of the sheets sent out of the collating unit 100 arrives at the stapling position Ps defined in the stapling device 1, the stapling device is operated to insert one or more staples ST into one or more stapling points prescribed on the leading end portion of the sheets. The finished sheaf of sheets s2 thus bound is sent out in a sheet forward direction Fd to the finish stacker 200.

Figure 3:
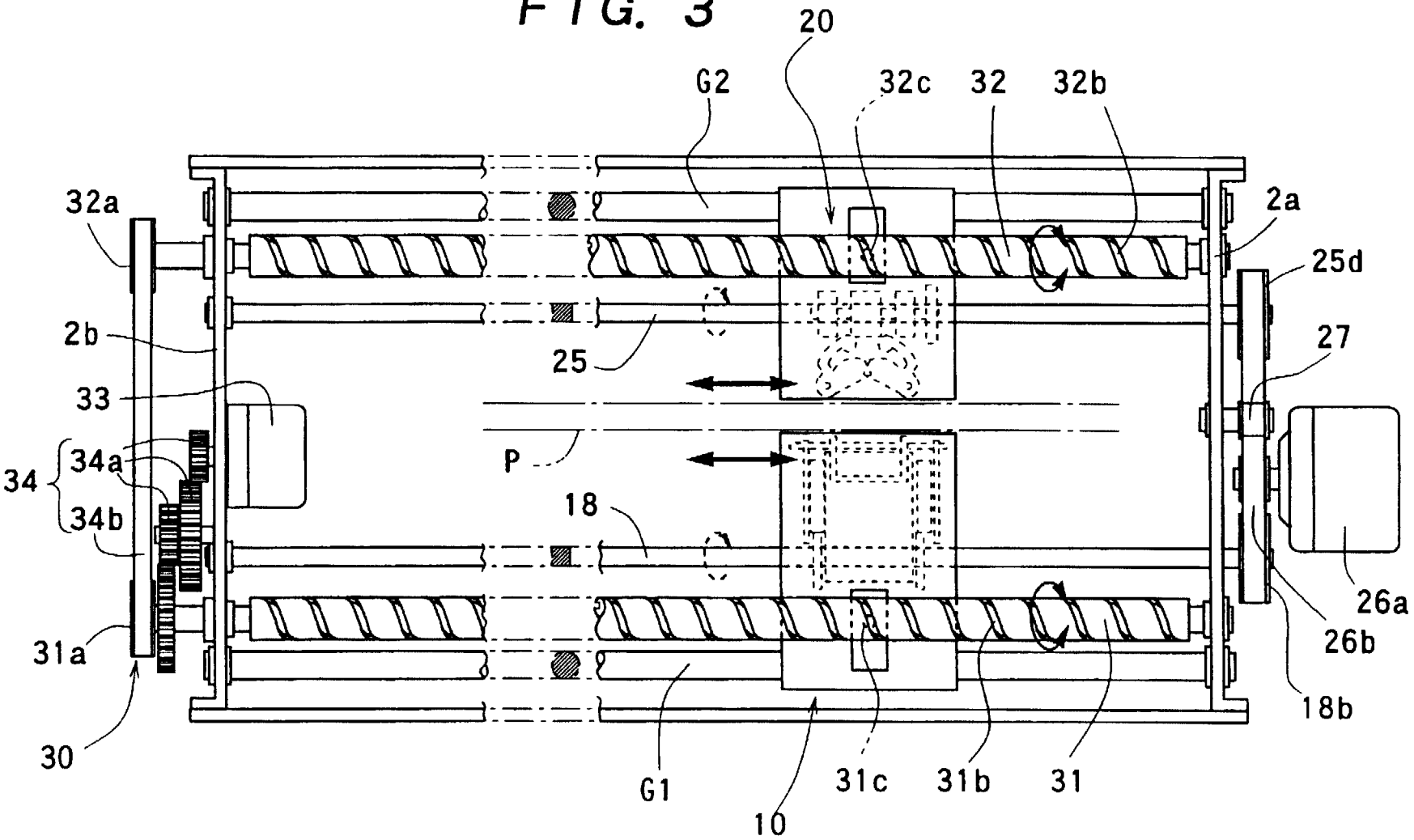
FIG. 3 is a front view schematically showing the device of FIG. 2.

As shown in FIG. 2 and FIG. 3, the stapling device 1 comprises a staple driver 10 and a clincher 20, which are opposed to each other astride a sheet passage P, and is provided with shifting means for varying a sheet receiving space between the staple driver 10 and the clincher 20 (height of the sheet passage P).

The staple driver 10 and the clincher 20 are always opposed to each other, so that the staple ST pushed out by the staple drive is received by the clincher 20 to bend the legs of the staple, thus firmly binding the sheets placed between the staple driver 10 and the clincher 20.

The opposed staple driver 10 and clincher 20 are respectively supported by at least one driver guide rod G1 and at least one clincher guide rod G2, which are retained in parallel between side panels 2*a* and 2*b* of the device frame, in the state movable in parallel along the rods in the direction perpendicular to the sheet forward direction Fd while preserving the sheet passage P.

The stapling device is further provided with position setting means 30 for moving in parallel the staple driver 10 and clincher 20 along the guide rods G1 and G2 in the direction traversing the sheet passage P to move the staple driver and clincher to the stapling position Ps determined relative to the sheets s1.

The position setting means 30 comprises lead screw rods 31 and 32 arranged between the side panels 2*a* and 2*b* in parallel to the guide rods G1 and G2 for moving the staple driver and the clincher, a driving power source 33 such as an electric motor for producing driving power to rotate the lead screw rods 31 and 32, and means for transmitting the driving motive power to the lead screw rods 31 and 32.

The lead screw rods 31 and 32 are provided at the respective one ends thereof with timing wheels 31*a* and 32*a*, so as to transmit rotational motion to the timing wheels 31*a* and 32*a* through a power transmission means 34 including transmission gears 34*a* and a timing belt 34*b*.

With spiral grooves 31*b* and 32*b* formed in the lead screw rods 31 and 32, slider pins 31*c* and 32*c* fixed on the staple driver 10 and the clincher 20 are engaged. Thus, by rotating the lead screw rods 31 and 32, the staple driver 10 and the clincher 20 are moved in parallel along the lead screw rods 31 and 32 and the guide rods G1 and G2, thus traversing the sheet passage P.

The staple driver 10 includes tilting means 11 disposed for tilting a driver case 10*b* about a shaft 10*a* so as to serve as means for shifting its position relative to the clincher 20, a staple wire cartridge 13 containing a roll of belt formed of a plurality of short straight staple wires Sr of which the staples ST are made, a retractable staple forming supporter 14 for one staple wire Sr given from the staple wire cartridge 13, forked punching member 15 for pushing down both end portions of the staple wire Sr to form the staple ST in a substantially square-bracket shape (] ) or a substantially U shape, and a driving blade 16 for thrusting the substantially square-bracket shaped staple ST toward the clincher 20.

The driver case 10*b* is swingable vertically around the shaft 10*a* by operating the driver tilting means 11 including cam wheels 17 and cam levers 19 and accommodates the forming supporter 14, punching member 15, and driving blade 16.

The driving blade 16 is actuated by the driver tilting means including the cam wheels 17 and cam levers 19 rockingly movable with the rotation of the cam wheels 17. The cam wheels 17 are rotated by use of a rotation 1transmission means including gears 18*a* mounted on a driver driving shaft 18 and intermediate gears 18*b*. The forming supporter 14 and the punching member 15 are also driven through the medium of a gear 18*c* (FIG. 2). The driving shaft 18 has a rectangular section so as to allow the gears 18*a* to slide along the shaft, so that rotational motion is transmitted to the cam wheels 17.

Each cam lever 19 has a cam slot 19*a* for receiving a rotary pin 17*a* of the cam wheel 17, so that the lever 19 is rocked with the rotation of the cam wheel 17. The cam lever 19 is further provided in its working arm part 19*b* with a slide slot into which an operative shaft 16*a* connected with the driving blade 16 is fitted.

Thus, with the rotation of the driving shaft 18, the cam wheel 17 rotates to move vertically the operative shaft member 16*a* to make the driving blade 16 thrust the staple.

The driver 10 supported on the shaft 10*a* assumes its lowermost point (driver waiting position Pw1) in non-operation of stapling, and then, is rockingly moved about the shaft 10*a* to its uppermost working point Px1 by raising the working arm part 19*b* of the cam levers 19 to bring the operative shaft member 16*a* into contact with the driver 10 while thrusting the driving blade 16 upward.

Thus, the cam levers 19 are rocked in conjunction with the cam wheels 17 rotated by the driving shaft 18 to move the driver 10 up and down between the driver waiting point Pw1 and the driver working point Px1.

Figure 5:
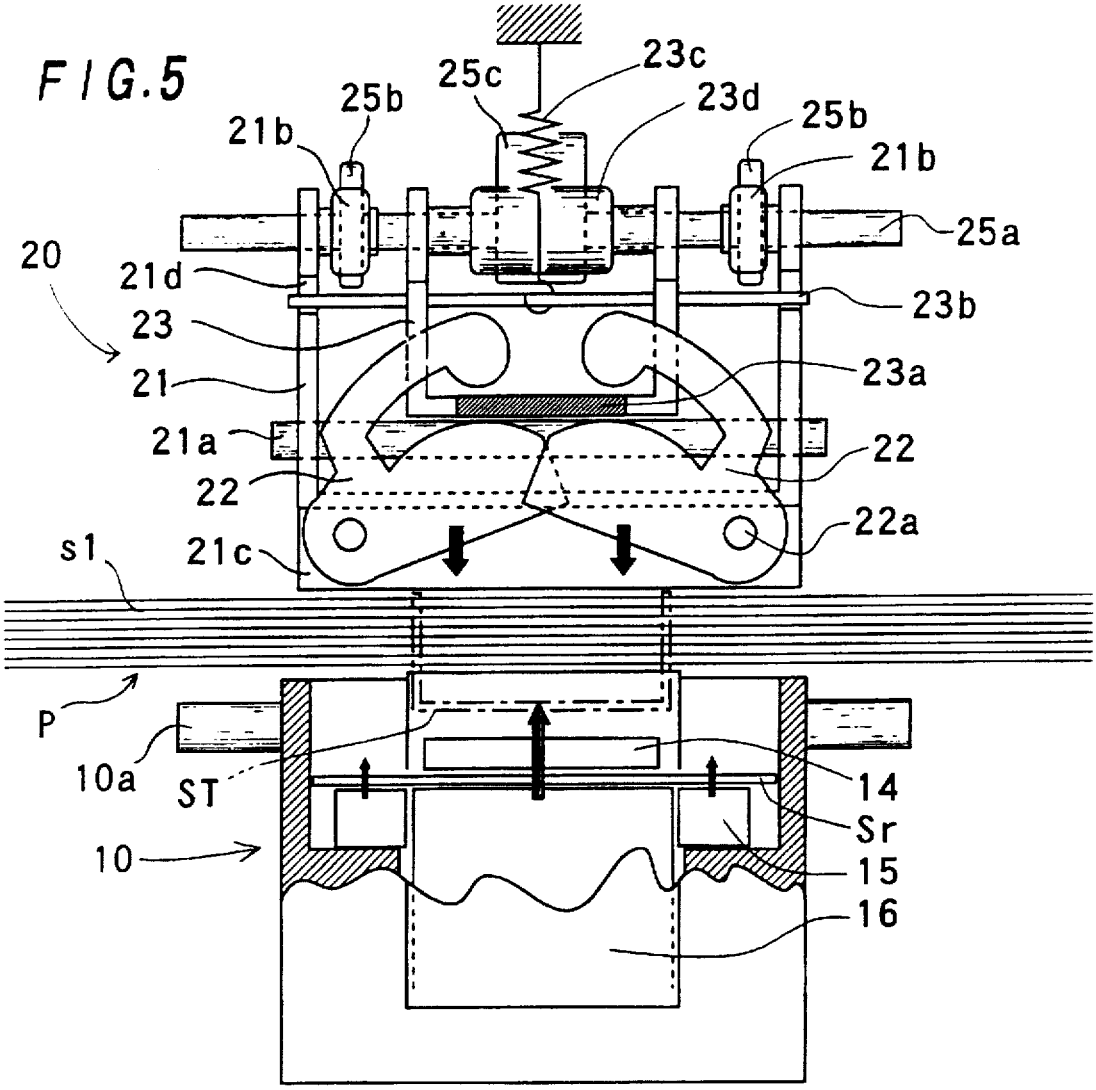
FIG. 5 is a schematic front view showing the staple driver and clincher of the device of this invention.
Figure 6:
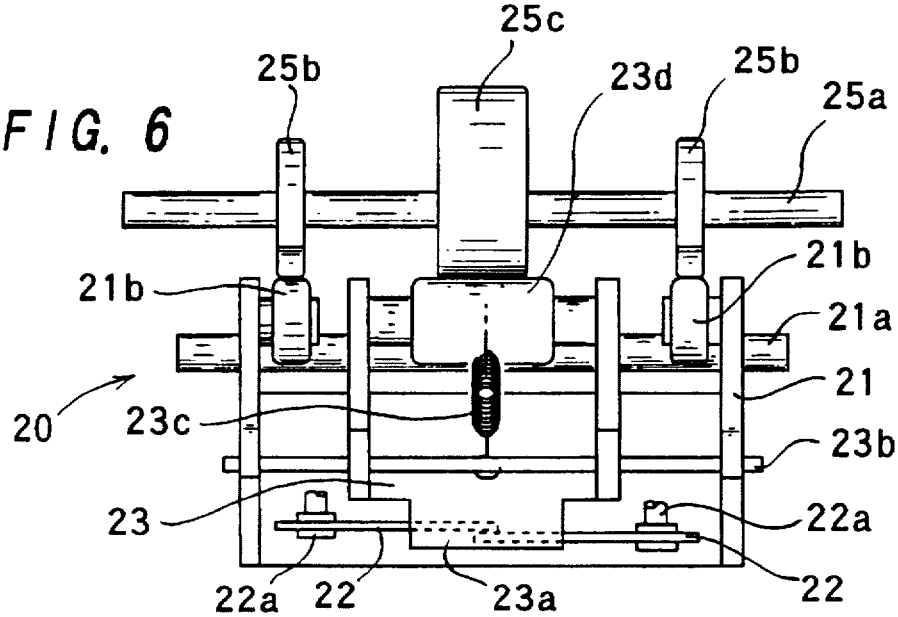
FIG. 6 is a schematic plane view showing the clincher of the device of this invention.

Upon formation of the staple ST from one straight staple wire Sr, the staple driver 10 executes the stapling action to insert the staple into the sheets s1. That is, as shown in FIG. 5, the staple ST is formed by placing one staple wire Sr between the forming supporter 14 and the punching member 15, and pushing the punching member 15 toward the forming supporter side with the rotation of the driving shaft 18, thus bending the staple wire Sr into a substantially square-bracket shape or substantially U shape conforming to the configuration of the forming supporter 14.

Figure 9B:
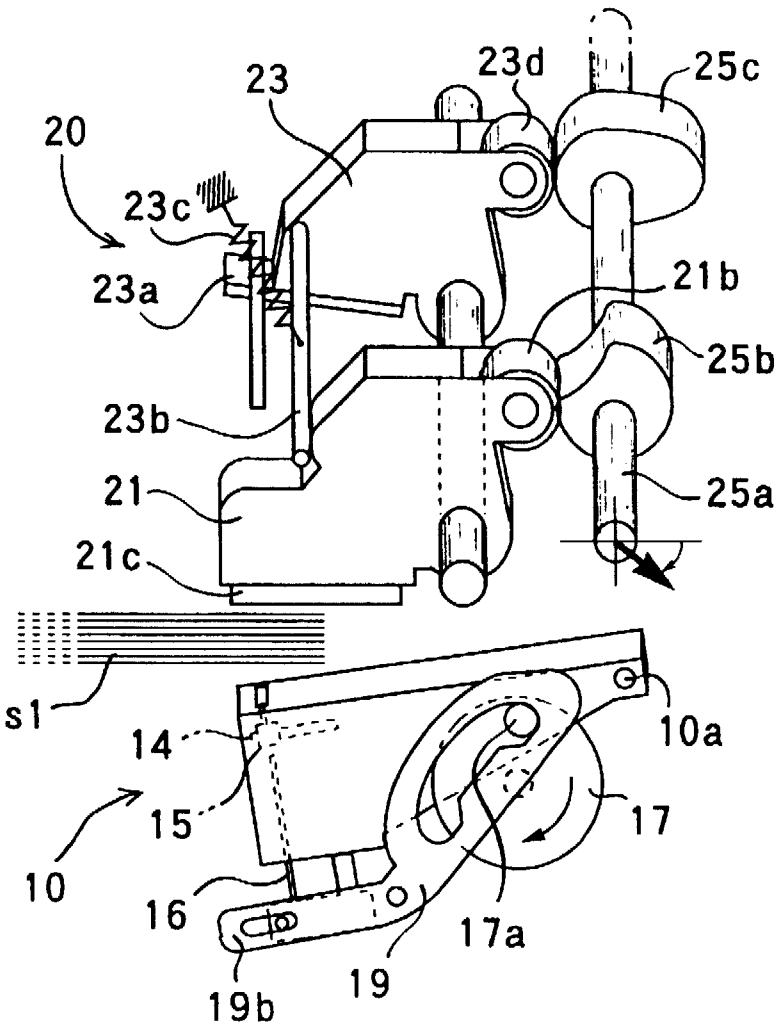
FIG. 9A through FIG. 9D are schematic side views explanatory of the operating principle of the device of this invention.

With the successive rotation of the driver shaft 18, the forming supporter 14 is retracted to open a space forward of the staple ST as shown in FIG. 9B. By successively rotating the driver shaft 18, the cam levers 19 are rocked to move the driving blade 16 toward the clincher 20 to thrust the staple ST into the sheets s1 held between the staple driver 10 and the clincher 20.

The clincher 20 has a function of bending the leg portions of the staple ST piercing through the sheets s1, and comprises an anvil base 21 having an anvil plate 21*c* rotatably supported by a rotation axis 21*a*, a pair of clinching flappers 22 supported rotatably on the anvil base 21 by means of pivot pins 22*a* fixed on the anvil plate 21*c* for bending inwardly the leg portions of the staple piercing through the sheets s1, a clinching member 23 having a working member 23*a* acting on the clinching flappers 22 to open or close, and clincher tilting means 24 serving as means for shifting the position relative to the staple driver 10 so as to differentially tilt the anvil base 21 and the clinching member 23.

Figure 7:
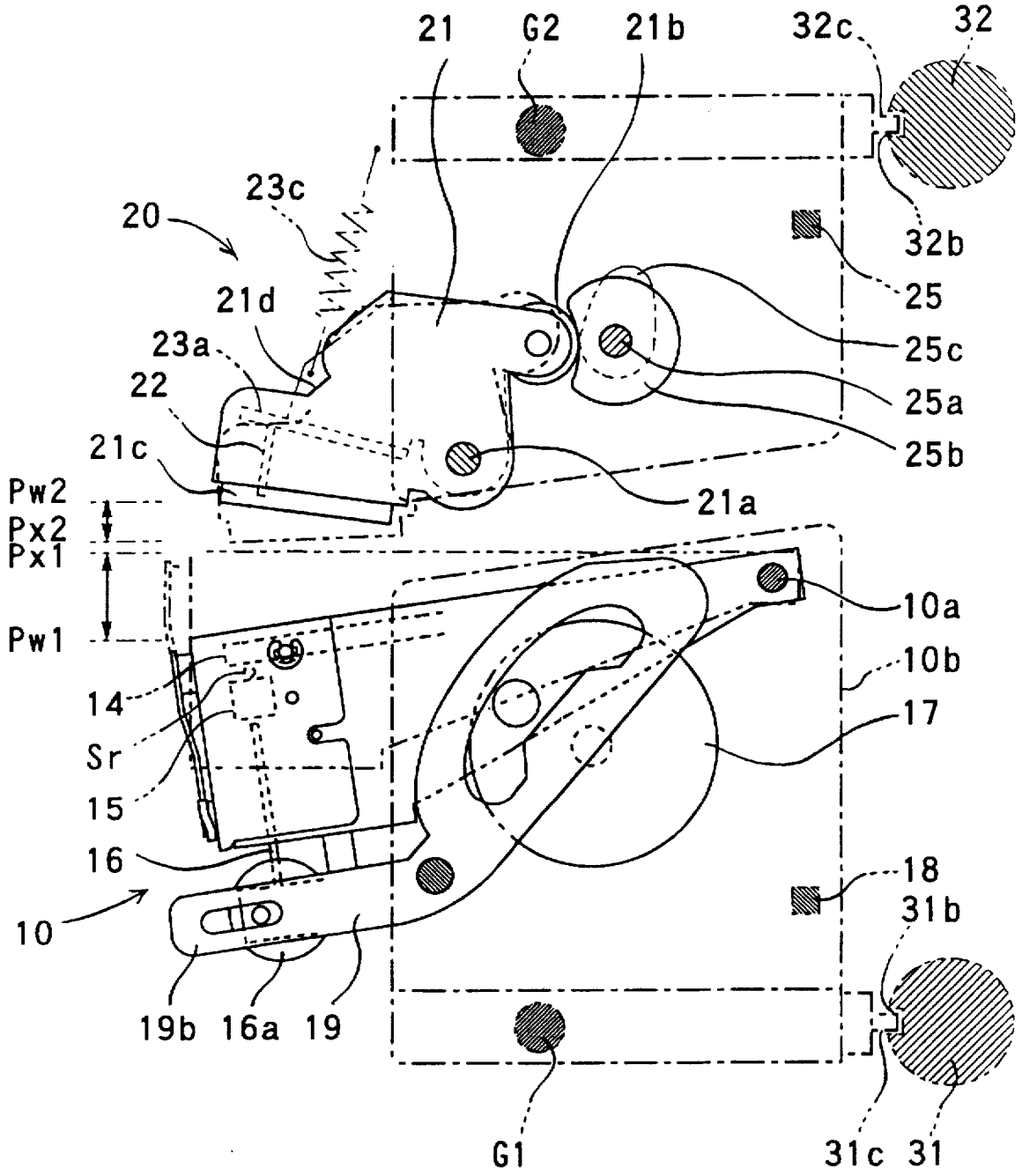
FIG. 7 is a schematic side view showing the staple driver and the clincher of the device of this invention.
Figure 9A:
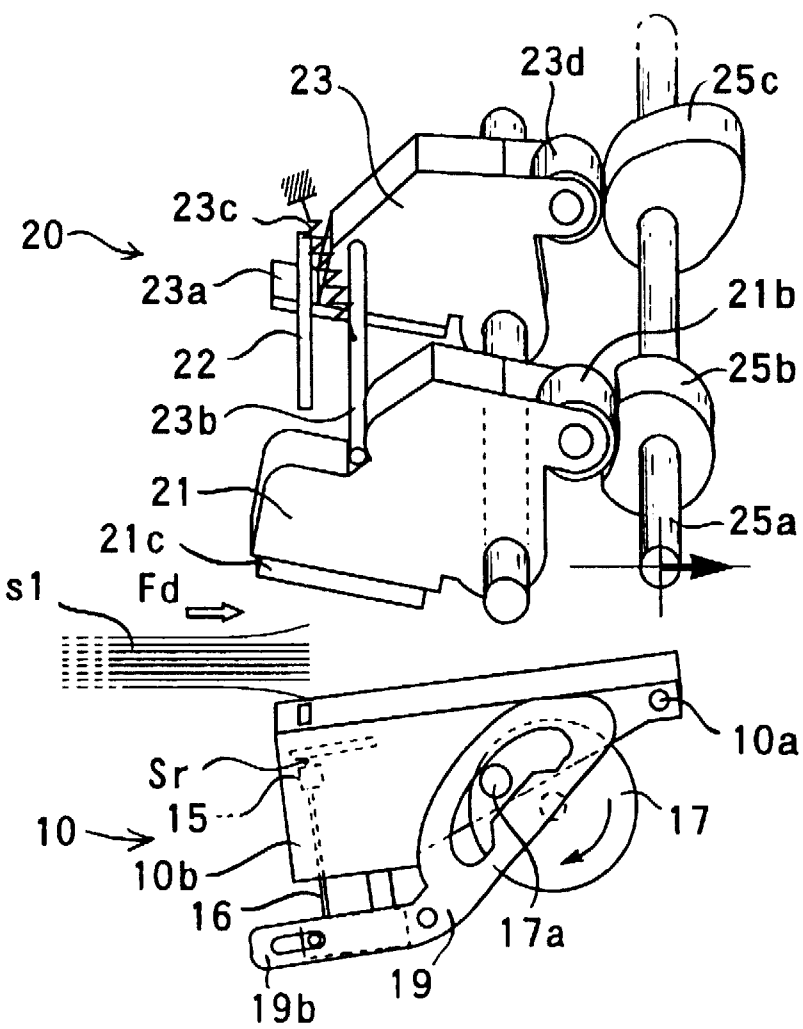

The clinching member 23 is urged upward by a spring 23*c* through a 10 lifting shaft 23*b* so as to assume its upper position. The lifting shaft 23*b* protrudes laterally so as to place their end portions in notches 21*d* formed in the anvil base 21. Thus, in the normal state, the lifting shaft 23*b* comes into contact with the upper sides of the notches 21*d* to hold the anvil base 21 at the upper position by the action of the spring 23*c*, as shown in FIG. 7 and FIG. 9A.

The clincher tilting means 24 is retained by a cam shaft 25*a* which rotates with the rotation of a clincher driving shaft 25, and includes anvil rocking cams 25*b* each having an arc-shaped dent in part, and a substantially elliptical flapper rocking cam 25*c* having a major diameter part and a minor diameter part.

Figure 4:
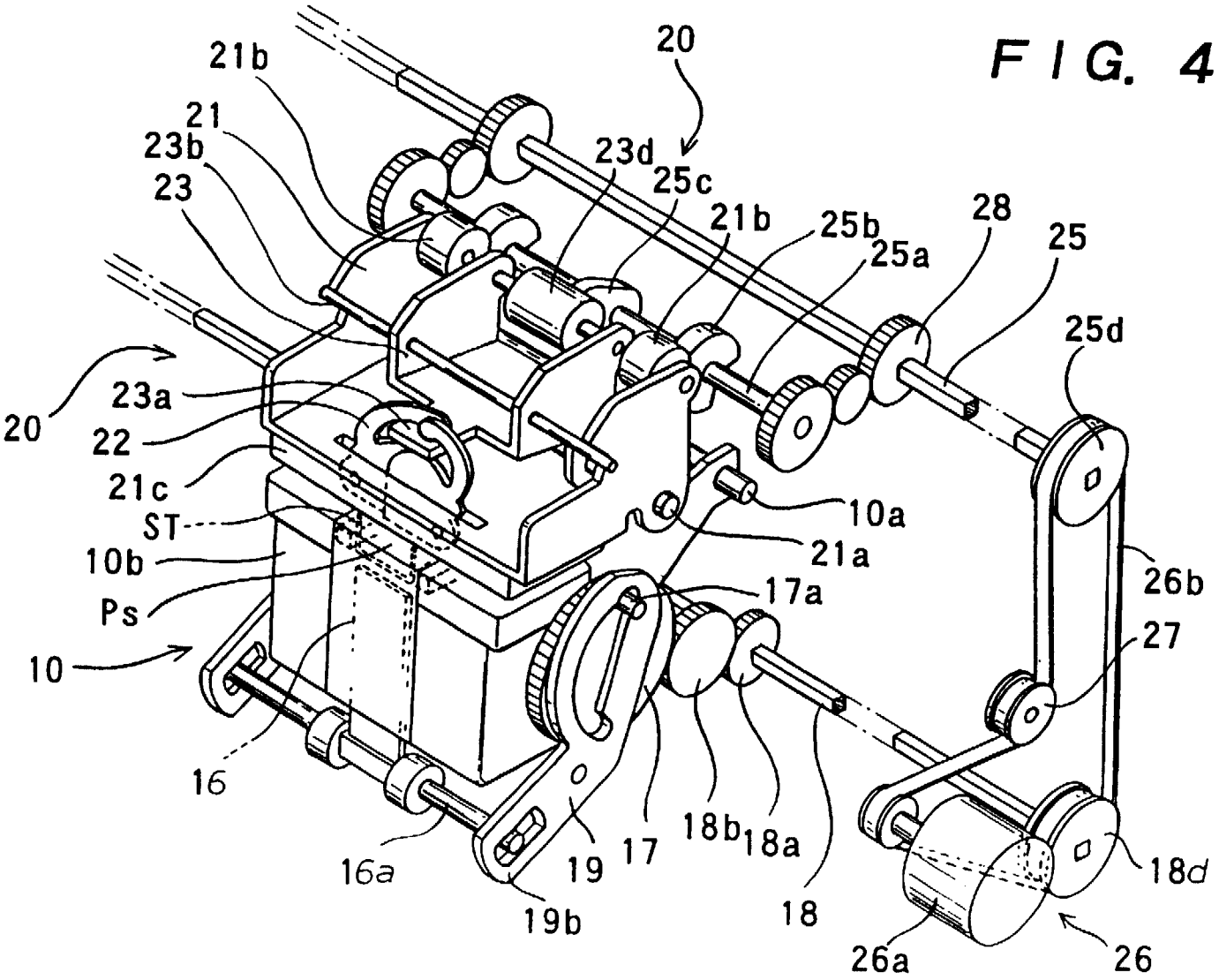
FIG. 4 is an enlarged perspective view schematically showing the principal portion including a staple driver and a clincher of the device of FIG. 2.

As shown in FIG. 3 and FIG. 4, the driver driving shaft 18 for the staple driver 10 and the clincher driving shaft 25 for the clincher 20 are driven to rotate by a stapling drive means 26 incorporating a single driving power source 26*a*. Since all the component elements of the device can be actuated by the single power source, the driver driving shaft 18 and the clincher driving shaft 25 can be rotated precisely without causing, any timing error.

The stapling drive means 26 incorporates a single electric motor serving as the driving power source 26*a* which provides driving power to a timing wheel 25*d* attached to one end of the driving shaft 18 through a timing belt 26*b*.

Denoted by 27 is a tension roller for imparting a tension force to the timing belt 26*b*.

The clincher driving shaft 25 has a rectangular section so as to allow the gears 28 to slide along the shaft, so that rotational motion is transmitted to the cam shaft 25*a*.

Figure 8B:
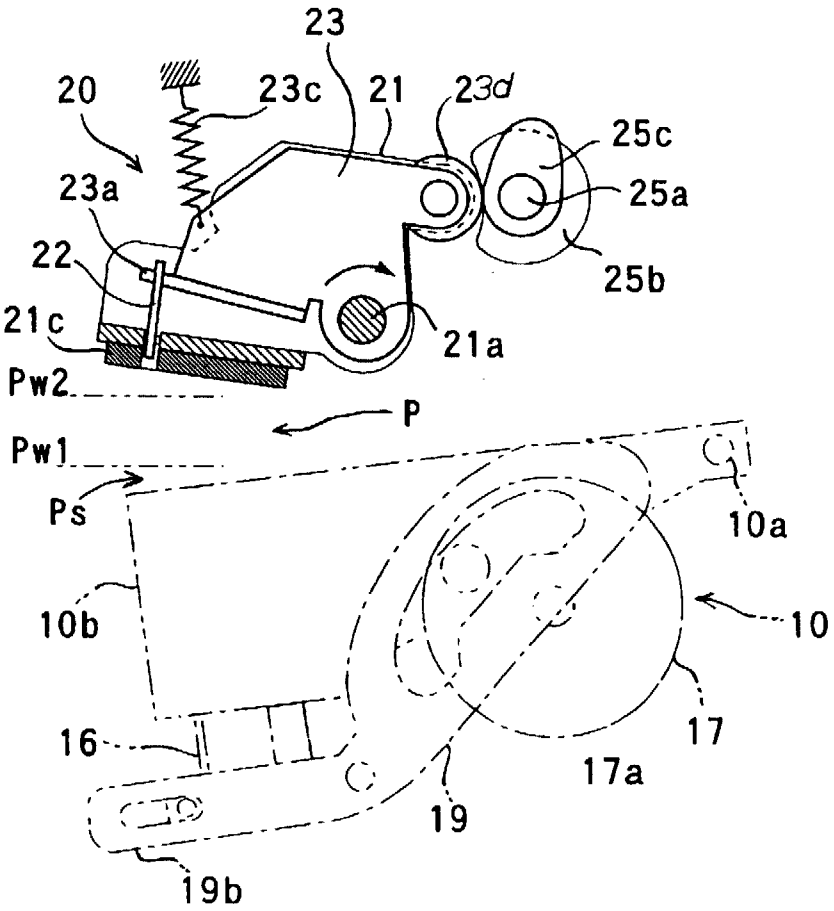
FIG. 8B is a schematic side section showing the clincher of the device of this invention.
Figure 8A:
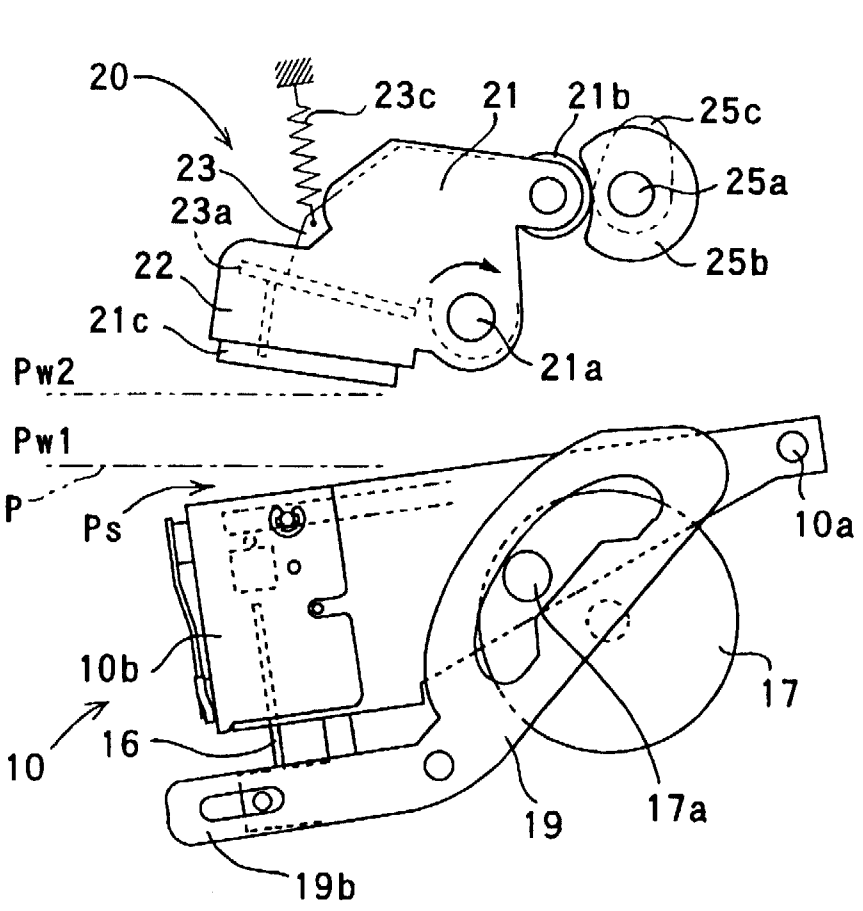
FIG. 8A is a schematic side view of the clincher of the device of this invention.

When the arc-shaped dents in the rocking cams 25b while in rotation are confronted by follower 21b, the anvil base 21 moves backward as shown in FIG. 8A. At this time, the clincher 20 assume its waiting point (Pw2) at a most distance from the staple driver 10.

The clinching member 23 acquires a rotational motion in the direction indicated by the arrow in FIG. 8B by means of the spring 23c, to bring the follower 23d into press contact with the flapper rocking cam 25c. Thus, by rotating the substantially elliptical flapper rocking cam 25c, the clincher 23 is rockingly moved against the spring 23c in conformity with the configuration of the flapper rocking cam 25c.

When the major diameter part of the flapper rocking cam 25c is confronted by the follower 23d, the clincher 23 rotates in the opposite direction of the arrow shown in FIG. 8B, thus to make the working member 23a push down the clinching flappers 22 to close. At this time, the clincher 23 assumes its clincher working point Px2, which is most close to the staple driver 10, along with the anvil base 21 urged by the cam 25b.

Now, the sequence of stapling operation of the components of the staple driver 10 and clincher 20 which are operatively associated with each other will be explained with reference to FIG. 9A through FIG. 9D and FIG. 10A through FIG. 10D. The states shown in FIG. 9A to FIG. 9D take place at time points f9A to f9D in FIG. 11, respectively.

FIG. 9A illustrates the stapling device in a non-operation state or a state in standing ready for stapling. By way of explanation, the cam shaft 25a assumes a basic angle (0°) in the initial state of the device.

In the initial state, the staple driver 10 and the clincher 20 are positioned at their waiting points Pw1 and Pw2, so that the sheet passage P is made wider to facilitate the admission of the sheets s1 thereinto.

That is, both the minor diameter parts of the rocking cams 25b and 25c held by the cam shaft 25a come in contact with the followers 21b and 23d, so that the clinching member 23 assumes its waiting point Cw, and the anvil base 21 is positioned at the waiting point Pw2. On the other hand, in the staple driver 10, the cam wheels 17 brings the working arm parts 19b of the cam levers 19 to their lower positions, thus placing the staple driver 10 at the driver waiting point Pw1 (time point f9A in FIG. 11).

As a result, the staple driver 10 and the clincher 20 are positioned at a most distance from each other, to make the sheet passage P wider so much as to smoothly admit the sheets s1 into the sheet passage without hindrance.

In the staple driver 10 in this non-operation state, the straight staple wire Sr is retained between the forming supporter 14 and the punching member 15.

Figure 10A:
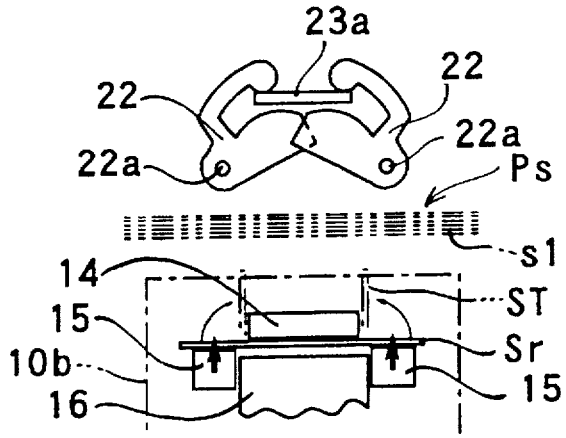
FIG. 10A through FIG. 10B are schematic front views explanatory of the operating principle of the principal components of the device of this invention.

Next, when an instruction to execute stapling is given upon feeding the sheets s1 along the sheet passage P by operating the sheet transport means 106, the driver driving shaft 18 and the clincher driving shaft 25 start to rotate, thus rotating the cam shaft 25a of the clincher 20, and at the same time, the staple wire Sr is bent into a substantially square-bracket shape by the punching member 15 as shown by the arrows in FIG. 10A, thereby to form the staple ST.

Figure 11:
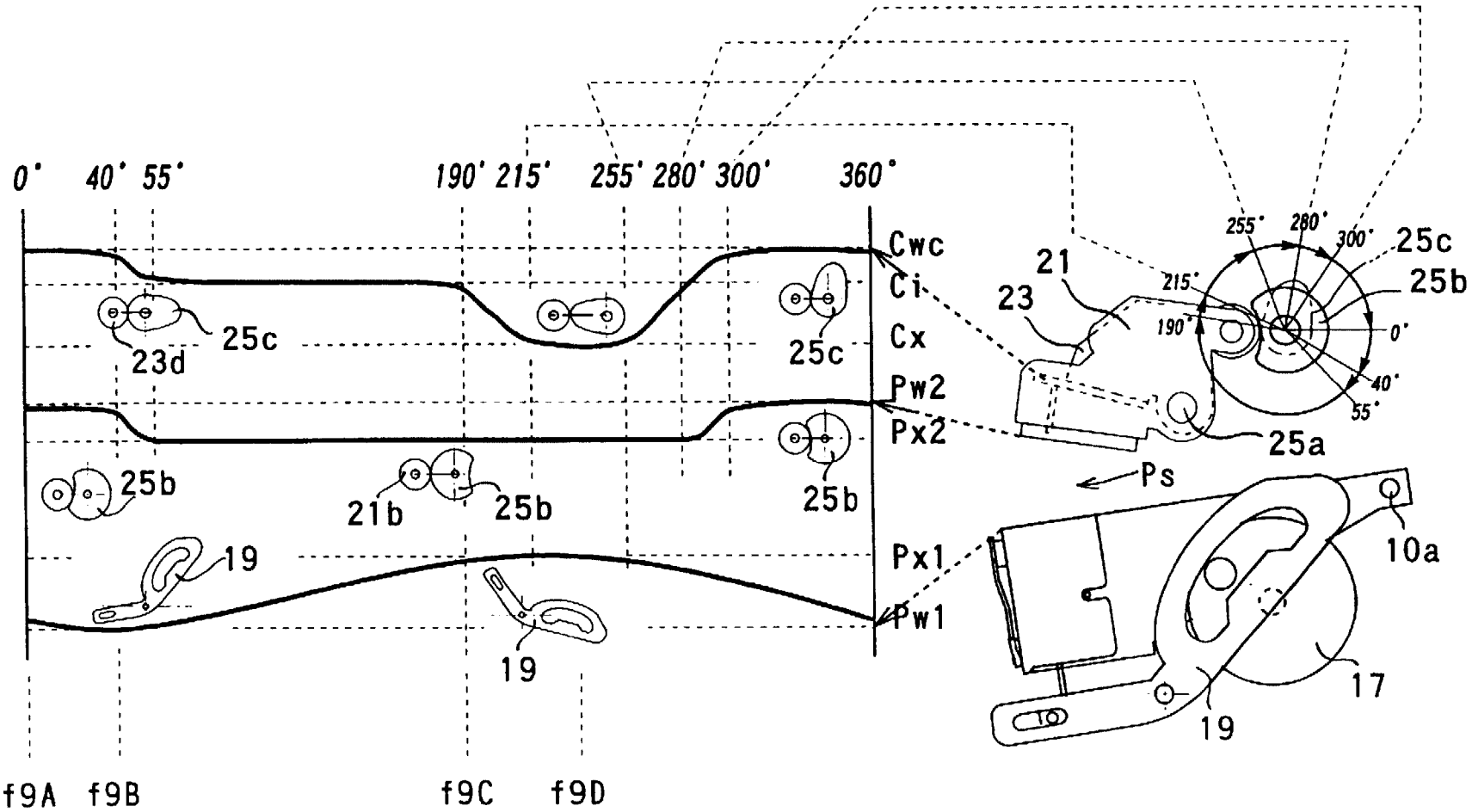
FIG. 11 is an explanatory diagram showing the state in which the principal components of the device of this invention are operated.

At this time, however, the working cam parts 19b of the cam levers 19 are positioned at their lower point, but thrusting of the staple ST by use of the driving blade is not started yet (time point f9B in FIG. 11).

In the clincher 20, when the cams 25b and the cam 25c start to rotate with the rotation of the cam shaft 25, the contact point of the follower 21b of the anvil base 21 with each cam 25b is being shifted from the arc-shaped dent of the cam toward the major diameter part of the cam as shown in FIG. 9B, and the cam 25c assumes the state in which the middle part (portion Ci) between the minor diameter part and the major diameter part thereof comes into contact with the follower. Consequently, the anvil base 21 moves downward to the clincher working point Px2 and comes in touch with the sheets s1.

As a result, the sheets si are pressed down by the anvil base 21 prior to the stapling operation of the staple driver 10, thus being stably situated at the stapling position without causing slippage.

Simultaneously, the working member 23a of the clinching member 23 is urged upward by the spring 23c, so that the clinching flappers 23 are in their spread state as shown in FIG. 10A.

Figure 9D:
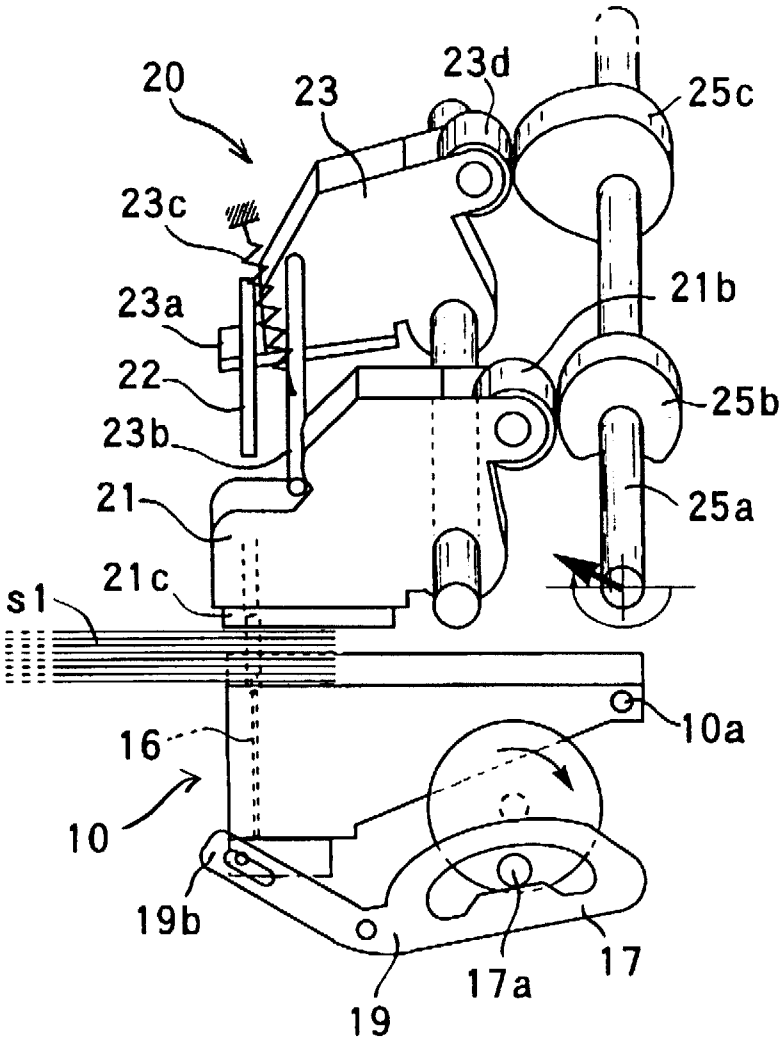
Figure 9C:
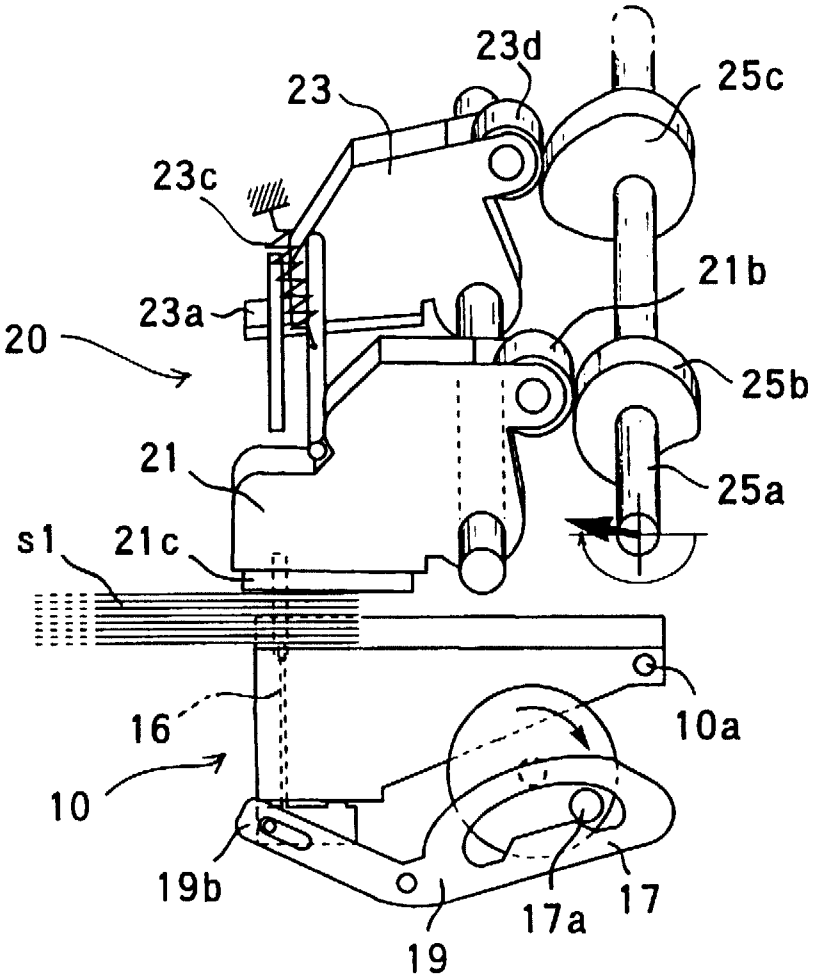
Figure 10B:
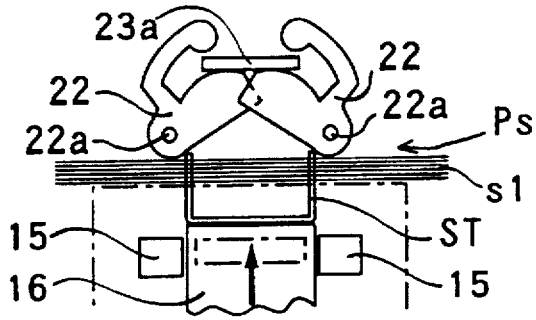

As the cam wheels 17 further rotate, the staple driver 10 moves to the driver stapling point Pw1 with the rocking motion of the cam levers 19 and comes in contact with the lower surface of the sheets s1, as illustrated in FIG. 9C, and then, the staple ST is thrust into the sheets s1 with the upward movement of the driving blade 16 (FIG. 10B).

Figure 10C:
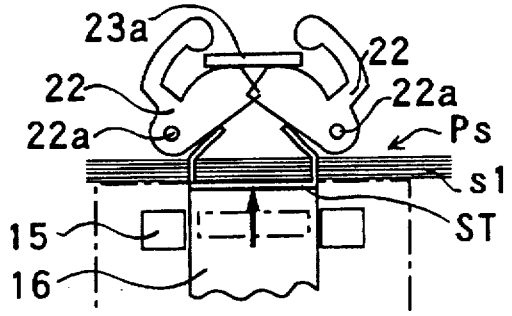
Figure 10D:
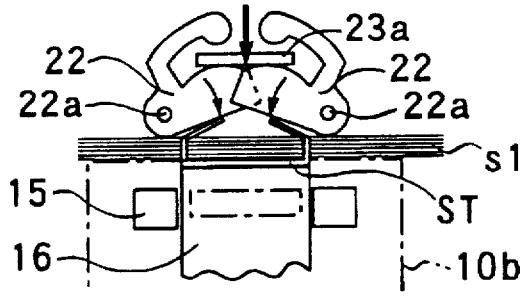

At this time, the contact point of the follower 23d with the cam 25c is in the process of being shifted to the major diameter part of the cam (time points f9C to f9D in FIG. 11), so that the working member 23a goes down to rotate the clinching flappers 22 inwardly about the pivot pins 22a to close while letting the anvil plate 21c press down the sheets s1. Thus, the leg portions of the staple ST which is thrust by means of the staple driver 10 and pierces the sheets s1 start to bend (FIG. 10C to FIG. 10D). At this time, the clinching member 23 moves downward about the working point Cx, and the anvil plate 21c of the clincher 20 is positioned at the clincher working point Px2.

Figure 10E:
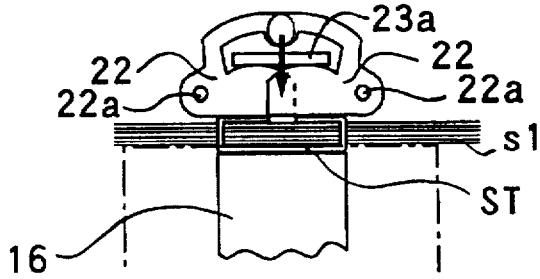

Finally, the driver case 10b is further pushed up at the driver working point Px1 with the rotation of the cam wheels 17 in the staple driver 10, consequently to further thrust the staple ST upward, as shown in FIG. 9D. At the same time, the major diameter part of the rocking cam 25c comes into contact with the follower 23d in the clincher 20, thus letting the working member 23a depress the clinching flappers 22 so as to strongly bend the leg portions of the staple as shown in FIG. 10E.

After binding the sheets s1 in the aforenoted manner, the driving shaft 18 for the staple driver and the driving shaft 25 for the clincher are successively rotated and brought to a stop when the components of the staple driver 10 and the clincher 20 come into the state shown in FIG. 9A.

When the sheets s1 are required to be bound with a plurality of staples into a sheaf of sheets bound, the aforementioned manner may be repeated upon moving in parallel the staple driver 10 and the clincher 20 together along the guide rods G1 and G2 to another stapling position prescribed on the sheets while the driver 10 and clincher 20 are still in their non-operation state shown in FIG. 9A.

Then, the finished sheaf of sheets s2 thus bound in the aforementioned manner is forwarded in the direction of the arrow Fd shown in FIG. 1 and sent out from the stapling device 1 to the finish stacker 200. Thus, a series of processes of putting in order the sheets discharged from the image forming device and binding the sheets with at least one staple can be automatically proceeded.

Incidentally, the explanation of the operation of the components of the stapling device is made hereinbefore on the basis of the angle of the cam shaft 25a by way of example, but the angle of the cam shaft 25a is by no means limitative and the stapling device may be operated on any conditions.

As described above, according to the stapling device of this invention, since the sheet passage formed between the staple driver 10 and the clincher 20 can be enlarged when sheets to be bound with one or more staples are discharged from the image forming device and fed to the stapling position Ps through the sheet passage, the sheets to be bound can be successfully sent to and placed at the stapling position Ps without hindrance even if they are slightly wavy. Furthermore, since the anvil base 21 comes in contact with the sheets s1 prior to the touch of the staple driver 10 with the sheets in the stapling operation, the sheets are stably retained at the stapling position without causing slippage or other disadvantages. The stapling operation of the associated staple driver 10 and clincher 20 can be performed steadily by adequately arranging and controlling the cam wheels 17 and cam levers 19 of the staple driver 10, and the anvil rocking cam **25*b* and flapper rocking cam 25*c* of the clincher 20 so as to fulfill the characteristics shown in FIG. 11**.

The illustrated embodiment employs two followers **21*b* on the anvil base 21 and two corresponding anvil rocking cams 25*b* in order to laterally balance the device, but the numbers of the followers 21*b* and rocking cams 25*b*** are not specifically limited.

Although the stapling drive means 26 for transmitting the driving power from the driving power source 26 to the driver driving shaft 18 and the clincher driving shaft 25 makes use of the timing belt **26*b*, other transmission means such as gears may be used instead of the belt. Also, although the position setting means 30 includes gears 34*a* in the transmission means 34**, a timing belt may be used in place of the gears. Thus, any other means may be used in the motive force transmission system in the device.

Although the device is provided with one guide rod G1 for the staple driver 10 and one guide rod G2 for the clincher 20, two or more guide rods may be used for synchronously moving in parallel the respective driver and clincher.

As is apparent from the foregoing description, since the automatic stapling device according to the present invention is provided with the shifting means capable of precisely and stably adjusting the sheet receiving space between the staple driver and the clincher which are opposed astride the sheet passage so as to widely separate the staple driver and the clincher from each other to widen the sheet passage by using a single common driving means when standing by ready for stapling, the sheets can be successfully and readily admitted into the space between the staple driver and the clincher without hindrance when the device is in the non-operation state or on standby. Furthermore, since the staple driver and the clincher placed at the stapling position are differentially operated so that the sheets at the stapling position are supported by the clincher before the staple driver comes into contact with the sheets, the stability of stapling can be secured without causing slippage of sheets. Besides, since the stapling device of the invention has no need for a complicated controlling system such as a high-level servomechanism for controlling the staple driver and the the clincher of the device and can be operated a compact and light driving system, the stapling device having excellent performance and durability can be realized.

Moreover, the stapling device of the invention has an excellent function of precisely and stably moving the staple driver and clincher to a prescribed stapling position with ease by means of the simple positioning mechanism with the single driving power source for moving in parallel the staple driver and the clincher along the sheet passage. In addition, the stapling device of the invention can be easily handled, maintained and attached to the sheet discharge part of an image forming device such as a printer and a copying machine, and besides, it can automatically insert one or more staples into one or more stapling points prescribed on the sheaf of sheets successively sent out from the image forming device, thereby to bind the sheets quickly.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. An automatic stapling device comprising:

sheet passage for allowing a sheaf of sheets to pass therethrough;

a staple driver for inserting a staple into said sheaf of sheets;

clincher for bending the staple piercing through the sheets, said clincher being separated from said staple driver;

stapling drive means for operating said staple driver to perform stapling and the clincher to bend the staple;

shifting means for bringing at least one of said staple driver and said clincher close to the other to secure said sheaf of sheets therebetween in a stapling operation, and widely separating said at least one of said staple driver and said clincher from the other when standing ready for stapling; and means for transmitting driving power produced by said stapling drive means respectively to said at least one of said staple driver and said clincher.

2. A stapling device according to claim 1, wherein said shifting means is formed of driver tilting means for bringing said staple driver close to said clincher in stapling operation, and widely separating said staple driver from said clincher in standing ready for stapling.

3. A stapling device according to claim 2, wherein said driver tilting means includes cam wheels disposed on said staple driver and cam levers so as to rockingly move said staple driver by rotating said cam wheels with said driving power produced by said stapling drive means to operate said cam levers.

4. A stapling device according to claim 1, wherein said shifting means is formed of clincher tilting means for bringing said clincher close to said staple driver in stapling operation, and widely separating said clincher from said staple driver in standing ready for stapling.

5. A stapling device according to claim 4, wherein said clincher tilting means includes cams disposed on said clincher and followers movable with said cams rotated by said driving power produced by said stapling drive means so as widely separate said clincher from said staple driver in standing ready for stapling.

6. A stapling device according to claim 1, wherein said shifting means comprises driver tilting means for bringing said staple driver close to said clincher in stapling operation and widely separating said staple driver from said clincher in standing ready for stapling, and clincher tilting means for bringing said clincher close to said staple driver in stapling operation and widely separating said clincher from said staple driver in standing ready for stapling.

7. A stapling device according to claim 6, wherein said driver tilting means includes cam wheels disposed on said staple driver and cam levers so as to rockingly move said staple driver by rotating said cam wheels with said driving power produced by said stapling drive means to operate said cam levers.

8. A stapling device according to claim 6, wherein said clincher tilting means includes cams disposed on said clincher and followers which are moved with said cams rotated by said driving power produced by said stapling drive means so as widely separate said clincher from said staple driver in standing ready for stapling.

9. A stapling device according to claim 6, wherein said driver tilting means includes cam wheels disposed on said staple driver and cam levers so as to rockingly move said staple driver by rotating said cam wheels with said driving power produced by said stapling drive means to operate said cam levers, and wherein said clincher tilting means includes cams disposed on said clincher and followers which are moved with said cams rotated by said driving power produced by said stapling drive means so as widely separate said clincher from said staple driver in standing ready for stapling.

10. A stapling device according to claim 1, further comprising a sheet transport means for feeding the sheets into between said staple driver and said clincher.

11. A stapling device according to claim 6, wherein said driver tilting means and said clincher tilting means are operated so as to bringing said clincher into contact with said sheets before said staple driver comes in contact with said sheets.

12. A stapling device according to claim 1, wherein said stapling drive means includes a single driving power source.

13. An automatic stapling device comprising:

a sheet transport means for feeding sheets along a sheet passage, a staple driver for inserting a staple into the sheets, a clincher opposed to said staple driver astride said sheet passage so as to bend the staple piercing through the sheets, stapling drive means having a single driving power source for operating said staple driver to insert the staple into the sheets and operating said clincher to bend the staple piercing through the sheets, driver tilting means mounted on said staple driver so as to position said staple driver at a driver stapling point for bringing said staple driver close to said clincher in stapling operation, and position said staple driver at a driver waiting point for widely separating said staple driver from said clincher in standing ready for stapling, clincher tilting means mounted on said clincher so as to position said clincher at a clinching point for bringing said clincher close to said staple driver in stapling operation, and position said clincher at a clincher waiting point for widely separating said clincher from said staple driver in standing ready for stapling, and means for transmitting driving power produced by said stapling drive means respectively to said staple driver and said clincher.

14. A stapling device according to claim 9, wherein said driver tilting means includes cam wheels disposed on said staple driver and cam levers so as to rockingly move said staple driver by rotating said cam wheels with said driving power produced by said stapling drive means to operate said cam levers.

15. A stapling device according to claim 13, wherein said clincher tilting means includes cams disposed on said clincher and followers which are moved with said cams rotated by said driving power produced by said stapling drive means so as widely separate said clincher from said staple driver in standing ready for stapling.

16. A stapling device according to claim 13, wherein said driver tilting means includes cam wheels disposed on said staple driver and cam levers so as to rockingly move said staple driver by rotating said cam wheels with the driving power produced by said stapling drive means to operate said cam levers, and wherein said clincher tilting means includes cams disposed on said clincher and followers which are moved with said cams rotated by the driving power produced by said stapling drive means so as widely separate said clincher from said staple driver in standing ready for stapling.

17. An automatic stapling device comprising:

a collating unit including a sheet catch tray for accumulating sheets and a sheet transport means for feeding the sheets placed on said sheet catch tray in a sheet forward direction along a sheet passage, a staple driver for inserting a staple into a sheaf of sheets, a clincher for bending the staple piercing through the sheets, stapling drive means for operating said staple driver to perform stapling operation and the clincher to bend the staple, shifting means disposed on at least one of said staple driver and clincher so as to position said staple driver and clincher at their working points close to each other in stapling operation, and position said staple driver and clincher at their waiting points separated from each other in standing by ready for stapling, means for transmitting driving power produced by said stapling drive means respectively to said staple driver and said clincher.

18. A stapling device according to claim 17, further comprising position setting means for allowing said staple driver and clincher opposed to each other astride said sheet passage to move in parallel in a direction perpendicular to said sheet forward direction.

19. A stapling device according to claim 17, wherein said position setting means comprises lead screw rods for moving said staple driver and said clincher, a single driving power source for producing driving power to rotate said lead screw rods, and means for transmitting the driving power to said lead screw rods.

20. A stapling device according to claim 17, wherein said driver tilting means includes cam wheels disposed on said staple driver and cam levers so as to rockingly move said staple driver by rotating said cam wheels with said driving power produced by said stapling drive means to operate said cam levers.

21. A stapling device according to claim 17, wherein said driver tilting means includes cam wheels disposed on said staple driver and cam levers so as to rockingly move said staple driver by rotating said cam wheels with said driving power produced by said stapling drive means to operate said cam levers, and wherein said clincher tilting means includes cams disposed on said clincher and followers which are moved with said cams rotated by said driving power produced by said stapling drive means so as widely separate said clincher from said staple driver in standing ready for stapling.

22. A stapling device according to claim 17, wherein said clincher includes an anvil base having one or more followers and disposed rotatable about a rotation axis, a pair of clinching flappers supported rotatably so as to open and close for clinching of the staple, a clinching member with one or more followers for closing and opening said clinching flappers, clincher tilting means having at least one anvil rocking cams retained by a cam shaft rotated by said stapling drive means so as to act on said followers of said anvil base, and one or more substantially elliptical flapper rocking cams acting on said followers of said clinching member, whereby said clincher is rockingly moved with movements of said followers of said anvil base and clinching member in conjunction with said anvil rocking cams and flapper rocking cams.

23. A stapling device according to claim 22, wherein said anvil base has an anvil plate for pressing the sheets.

24. A stapling device according to claim 23, wherein said clinching flapper are rotatably supported on said anvil base.

25. A stapling device according to claim 17, wherein said clincher includes an anvil base having one or more followers and disposed rotatable about a rotation axis, a pair of clinching flappers supported rotatably so as to open and close for clinching of the staple, a clinching member with one or more followers for closing and opening said clinching flappers, clincher tilting means having at least one anvil rocking cams retained by a cam shaft rotated by said stapling drive means so as to act on said followers of said anvil base, and one or more substantially elliptical flapper rocking cams acting on said followers of said clinching member, whereby said clincher is rockingly moved with movements of said followers of said anvil base and clinching member in conjunction with said anvil rocking cams and flapper rocking cams, so as to bring said clincher into contact with the sheets before said staple driver comes in contact with the sheets.

26. An automatic stapling device comprising a staple driver for inserting a staple into a sheaf of sheets, a clincher separated from said staple driver for bending the staple piercing through the sheets, stapling drive means having a single driving power source for producing driving power to operate said staple driver for performing stapling operation and said clincher for bending the staple, and means for transmitting driving power produced by said stapling drive means respectively to said staple driver and said clincher.

27. A stapling device according to claim 26, further comprising driver tilting means mounted on at least one of said staple driver and said clincher so as to widely separate said staple driver from said clincher in standing ready for stapling so as to permit the sheets to enter into therebetween, and bring said staple driver close to said clincher in stapling operation so as to retain the sheets therebetween.

28. An automatic stapling device comprising a staple driver for inserting a staple into a sheaf of sheets, a clincher separated from said staple driver for bending the staple piercing through the sheets, stapling drive means having a single driving power source for producing driving power to operate said staple driver for performing stapling operation and said clincher for bending the staple, and means for transmitting driving power produced by said stapling drive means respectively to said staple driver and said clincher, wherein said clincher is brought into contact with the sheets before said staple driver comes in contact with the sheets in stapling.

* * * * *